US005600755A

United States Patent [19]

Nakano et al.

[11] Patent Number: 5,600,755

[45] Date of Patent: Feb. 4, 1997

[54] VOICE CODEC APPARATUS

[75] Inventors: Takahiko Nakano, Ikoma; Syuuichi Yoshikawa, Nara, both of Japan

[73] Assignee: Sharp Kabushiki Kaisha, Osaka, Japan

[21] Appl. No.: 540,314

[22] Filed: Oct. 11, 1995

Related U.S. Application Data

[63] Continuation of Ser. No. 168,218, Dec. 17, 1993, abandoned.

[30] Foreign Application Priority Data

Dec. 17, 1992 [JP] Japan ..... 4-337650

[51] Int. Cl.[6] ..... G10L 3/02; G10L 9/00

[52] U.S. Cl. ..... 395/2.34; 395/2.1; 395/221; 395/2.28

[58] Field of Search ..... 370/13, 32.1; 381/29, 381/36–38; 395/2, 2.1, 2.34, 2.30–2.31, 2.28, 2.21

[56] References Cited

U.S. PATENT DOCUMENTS

| | | | |
|---|---|---|---|
| 4,924,508 | 5/1990 | Crepy et al. | 395/2.16 |
| 4,962,536 | 10/1990 | Satoh | 395/2.27 |
| 5,140,612 | 8/1992 | Yoshikawa | 375/8 |
| 5,233,660 | 8/1993 | Chen | 381/38 |
| 5,285,520 | 2/1994 | Matsumoto et al. | 395/2 |
| 5,307,441 | 4/1994 | Tzeng | 395/2.31 |
| 5,327,520 | 7/1994 | Chen | 39/2.28 |

FOREIGN PATENT DOCUMENTS

| | | | |
|---|---|---|---|
| 59-44684 | 3/1984 | Japan | G04G 1/00 |

OTHER PUBLICATIONS

*Voice,* Kazuo Nakata, Corona Publishing Co. Ltd., 1977, pp. 68–79.

*Digital Signal Processing,* Sadaoki Furui, Tokai University Press, 1985, pp. 100–105.

*Voice Digital Processing* (vol. 1), translated by Hisaki Suzuki, Corona Publishing Co., 1978, pp. 220–223 (from the original English language Digital Processing of Speech Signals, L. R. Rabiner et al., Prentice–Hall, 1978).

*Primary Examiner*—Tariq R. Hafiz

[57] ABSTRACT

A voice codec apparatus for predictive coding is disclosed, in which an automatic gain control circuit controls the gain for decoding by the use of a maximum prediction value generated at the time of coding. The accurate gain control of the output signal is thus made possible at the time of decoding.

5 Claims, 3 Drawing Sheets

VOICE CODEC APPARATUS

This application is a continuation of application Ser. No. 08/168,218 filed on Dec. 17, 1993, now abandoned.

BACKGROUND OF THE INVENTION

1. Field of the Invention

The present invention relates to a voice codec apparatus mounted in a telephone, an acoustic device or the like, or more in particular to a voice codec apparatus for performing predictive coding. In the present specification, the voice codec apparatus is defined as an apparatus including a coder for coding the voice signal and a decoder for decoding the coded voice signal.

2. Description of the Related Art

The voice codec apparatus is used in a speaker telephone and an audio apparatus or the like. The voice codec apparatus needs to control the gain of the decoded output signal in order to obtain an appropriate amplitude of an output voice signal. Conventionally, the gain control is made on the basis of the amplitude of a voice signal which is input to the voice codec apparatus. Hereinafter, the voice signal which is input to the voice codec apparatus is referred to as "the input voice signal".

As a method for making the gain control, there is a method in which the amplitude of the input voice signal is detected by an amplitude detection circuit and the gain is determined based on a maximum value of the detected amplitude. Such a method is disclosed in Japanese Laid-Open Publication No. 59-44684 entitled "Electronic Clock with Voice Storage Function". According to the description of the reference, the amplitude of the input voice signal is detected at the time of coding, a maximum value of the detected amplitude of the input voice signal is stored and the gain is controlled to an optimum value on the basis of the maximum value of the amplitude stored at the time of decoding.

According to a conventional gain control method described above, when an impulse noise having an amplitude larger than the maximum amplitude value of the input voice signal is superimposed on the input voice signal, the amplitude detection circuit incorrectly detects the amplitude of the impulse noise as the maximum value of the amplitude of the input voice signal. This is because the amplitude detection circuit cannot distinguish the impulse noise and the input voice signal. As a result, at the time of decoding, a gain determining circuit determines the gain on the basis of the maximum value which is different from the maximum amplitude value of the input voice signal. Thus, the conventional gain control method described above has a problem in that the gain determining circuit cannot control the gain accurately when an impulse noise having an amplitude larger than the maximum amplitude value of the input voice signal is superimposed on the input voice signal.

The problem mentioned above will be described below with reference to FIG. 3. FIG. 3 shows a waveform of the input voice signal and a maximum value of the input voice signal detected by the conventional amplitude detection circuit in the case where the impulse noise is superimposed on the input voice signal. As shown in FIG. 3, in the case where the impulse noise N is superimposed on the input voice signal S, the amplitude detection circuit for detecting the amplitude of the input voice signal detects the maximum value of amplitude of the impulse noise N as a maximum amplitude value Smax of the input voice signal S. The detected maximum value Smax is stored in memory. At the time of reproduction, a gain determining circuit reads the maximum value Smax stored in the memory, and the gain of the output signal is determined on the basis of the maximum value Smax. As a consequence, the gain thus determined is smaller than the gain in the absence of the impulse noise, which raises a problem in that the volume of the voice signal reproduced is smaller than that in the absence of the impulse noise.

SUMMARY OF THE INVENTION

The voice codec apparatus of this invention, includes a predictive coding means of an input voice signal so as to generate a voice code and a predicted value and decoding means for decoding the voice code and gain control means for controlling a gain at the end of decoding on the basis of a maximum value of the predicted value.

According to another aspect of the present invention, a voice codec apparatus includes: predictive coding means for coding an input voice signal so as to generate a voice code and a prediction value; maximum detecting means for detecting a maximum value of the prediction value at the end of coding; memory means for storing the maximum value and the voice code; decoding means for decoding the voice code so as to generate an output signal; and gain determining means for reading the maximum value stored in the memory means and for determining a gain of the output signal of the decoding means on the basis of the maximum value.

According to another embodiment, the predictive coding means makes predictive coding by differential quantization.

According to another embodiment, the memory means is a solid-state memory device for storing the voice code and the maximum value.

According to another aspect of the present invention, a method of coding a voice signal and decoding a coded voice signal comprising the steps of: a predictive coding step for coding an input voice signal so as to generate a voice code and a prediction value; a maximum detecting step for detecting a maximum value of the prediction value at the end of the predictive coding step; a storing step for storing the maximum value and the voice code; a decoding step for decoding the voice code so as to generate an output signal; and a gain determining step for reading the maximum value stored at the storing step and for determining a gain of the output signal at the decoding step on the basis of the maximum value.

As described above, the maximum prediction value generated by predictive coding of the input voice signal is stored as a maximum value of the input voice signal, and this maximum value is read at the time of decoding the voice code generated by predictive coding. The gain is controlled on the basis of this reading, thereby making it possible to control the gain for decoding accurately.

Thus, the invention described herein makes possible the advantages of providing a voice codec apparatus in which the gain of the output signal can be accurately controlled even when an impulse noise having an amplitude larger than the maximum amplitude value of an input voice signal is superimposed on the input voice signal.

These and other advantages of the present invention will become apparent to those skilled in the art upon reading and understanding the following detailed description with reference to the accompanying figures.

DESCRIPTION OF THE PREFERRED EMBODIMENTS

Figure 1:
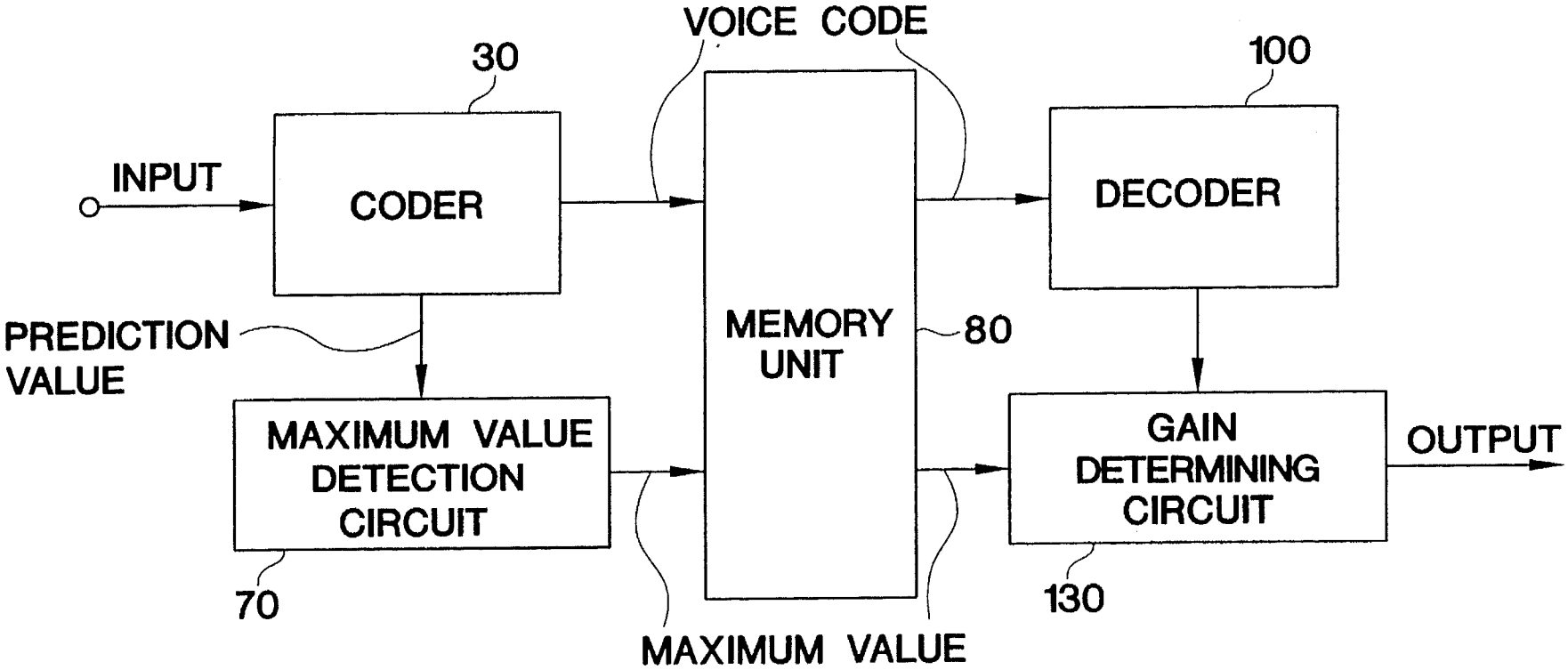
FIG. 1 is a block diagram showing a configuration of the voice codec apparatus according to the invention.

FIG. 1 shows a configuration of the voice codec apparatus according to the invention. As shown in FIG. 1, the voice codec apparatus according to the invention includes a coder 30, a maximum value detection circuit 70, a memory unit 80, a decoder 100 and a gain determining circuit 130. The coder 30 makes a predictive coding of the input voice signal so as to generate a voice code and a prediction value. The maximum value detection circuit 70 detects a prediction value generated at the coder 30, and detects the maximum prediction value at the end of the coding at the coder. The detected maximum value is stored in the memory unit 80.

At the time of decoding, the gain determining circuit 130 reads the maximum value stored in the memory unit 80 and determines the gain on the basis of the maximum value. The voice code generated by the coder 30, after being stored in the memory unit 80 temporarily, is decoded by the decoder 100. The gain determining circuit 130 reproduces the output of the decoder by the use of the gain thus determined.

As described above, when decoding the voice code generated by predictive coding of the input voice signal, the gain is controlled on the basis of the maximum prediction value generated by predictive coding of the input voice signal. In this way, even in the case where an impulse noise,is superimposed on the input voice signal, the gain for decoding can be accurately controlled.

Figure 4:
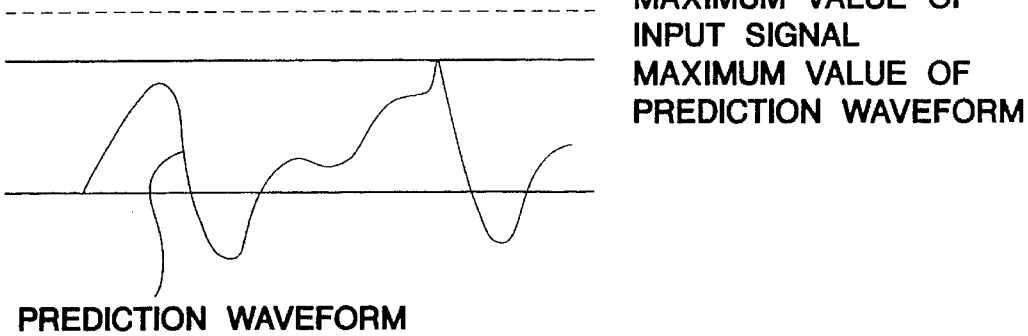
FIG. 4 is a schematic diagram showing a waveform of the input voice signal with an impulse noise superimposed thereon and a prediction waveform generated by a predictive coding circuit.

With reference to FIG. 4, the operation of the voice codec apparatus according to the invention will be described below. FIG. 4 shows a waveform of the voice input signal with an impulse noise superimposed thereon and a prediction waveform generated by the use of predictive coding technique. As shown in FIG. 4, the impulse noise is removed by predictive coding. The reason is described below. In predicting coding of the input voice signal, a correlation specific to the voice signal is used. The correlation associated with the impulse noise or noises due to instantaneous disconnection is so small that they are removed from the prediction value as noises are reduced by a low-pass filter. The correlation of the voice signal is described in detail in "Voice Digital Processing (Vol. 1)" translated by Hisayoshi Suzuki from an original English document, Corona Publishing Co. (1978), which is herein incorporated by reference.

As described above, impulse noises are removed by predictive coding, and therefore the maximum prediction waveform assumes a value very close to the maximum value of the input voice signal in the absence of the impulse noise. Further, since the voice code generated by the predictive coding circuit and the prediction waveform represent substantially the same signals, the gain control approach according to the invention is an ideal one in which the gain of a decoded voice code is controlled on the basis of the maximum value of the particular voice code.

Now, a configuration and operation of the voice codec apparatus according to the invention utilizing the differential quantization for predictive coding will be described below. The method for predictive coding using the differential quantization is one in which the next signal is predicted from an input voice signal and the predicted error is coded for achieving high-compression coding. The principle of this approach will be briefly explained. The input voice signal is sample-processed to produce a discrete signal. The signal thus sampled is correlated not only between contiguous signals but also between distant signals. As a result, the differential signal (difference) between contiguous signals or the correlation therebetween is utilized to code the difference between a predicted value and an actual signal, i.e., a predicted error, thereby compressing the information. The details of the differential quantization are described, for example, in "Digital Signal Processing" by Sadaoki Furui, Tokai University Press (1985), which is herein incorporated by reference.

Figure 2:
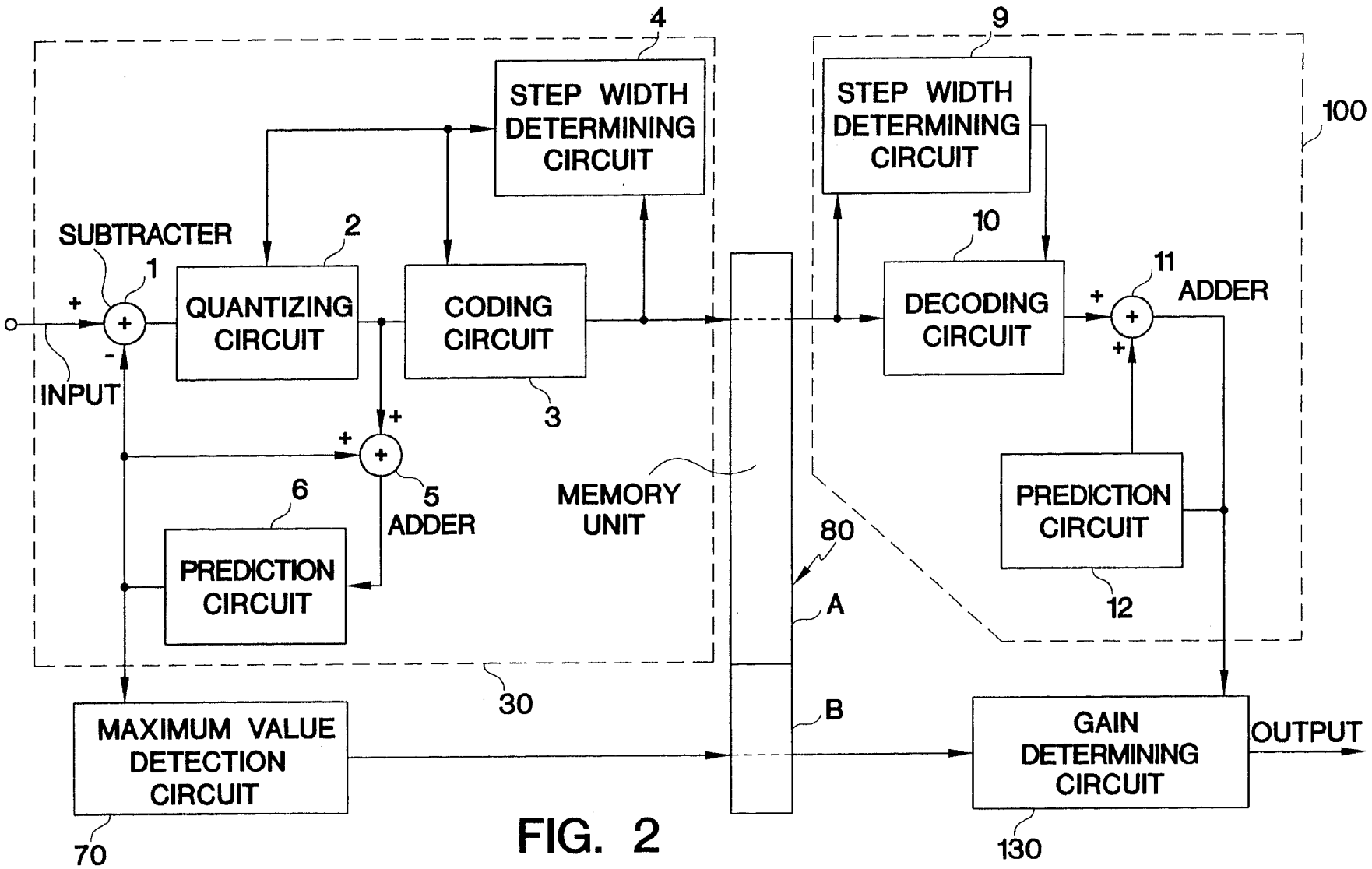
FIG. 2 is a block diagram showing a configuration of the voice codec apparatus for effecting predictive coding by differential quantization.
Figure 3:
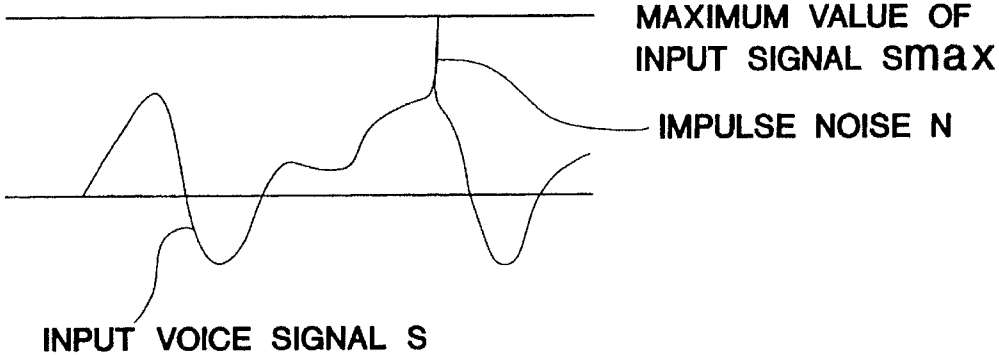
FIG. 3 PRIOR ART
FIG. 3 is a diagram showing a waveform of the input voice signal with an impulse noise superimposed thereon and a maximum value of the input voice signal detected by a conventional amplitude detection circuit.

FIG. 2 shows a configuration of a voice codec apparatus utilizing the differential quantization for predictive coding according to the invention. First, the configuration and operation of the coder 30 will be explained. The coder 30 includes a subtracter 1, a quantizing circuit 2, a coding circuit 3, a step width determining circuit 4, an adder 5 and a prediction circuit 6. The input voice signal is coded by the coder 30 in accordance with the differential quantizing 10 process thereby to generate a voice code and a prediction value. The subtracter 1 receives the input voice signal and a prediction value produced from the prediction circuit 6, and applies the difference between the input voice signal and a prediction value produced to the quantizing circuit 2. The quantizing circuit 2 quantizes the difference received from the subtracter 1. The signal thus quantized is coded at the coding circuit 3 thereby so as to generate a voice code. The memory unit 80 includes storage areas A and B. The voice code generated by the coding circuit 3 is stored in the storage area A of the memory unit 80. Also, the quantizing circuit 2 and the coding circuit 3 are supplied with a feedback signal for setting a step width factor from the step width determining circuit 4. In this way, the S/N ratio is improved by setting the step width factor at an optimum level.

The output of the prediction circuit 6 is detected by the maximum value detection circuit 70. The maximum value detection circuit 70 detects the maximum value of the prediction value when the coding by the coding circuit 3 is completed, the maximum value is stored in the storage area B of the memory unit 80.

TO fully understand this point assume that the storage area A of the memory unit 80 is 0000 to FFFF in hexadecimal notation, and the storage area B from 1000 to 1000F. The voice code corresponding to the third input voice signal, for example, is stored at 0300 to 03FF. The maximum prediction value corresponding to the third input voice signal is stored at location 1003 represented by 3 providing the value at the head of the location storing the corresponding voice code. By the use of the above mentioned process for storing signals, voice codes corresponding to the number F of voice signals and the maximum values can be stored independently at locations represented by a common value. As a result, the maximum value corresponding to a voice code can be easily read out at the time of decoding the voice code.

As described above, the high-compression coding by the differential quantization reduces the amount of the voice code to be stored, thereby leading to the advantage of a small-capacity solid-state storage device typically including RAM that can be used for the memory unit. The solid-state storage device, unlike the magnetic recording tape, allows the stored data stored at a given location thereof to be taken out randomly, and therefore the voice code described above and the corresponding maximum value can be stored independently of each other.

Now, the configuration and operation of the decoder 100 will be explained. The decoder 100 includes a step width determining circuit 9, a decoding circuit 10, an adder 11 and a prediction circuit 12. The decoder 100 reads and decodes the voice code stored in the storage area A of the memory unit 80, and applies decoded voice code to a gain determining circuit 130. The decoding circuit 10 reads out the voice code stored in the storage area A of the memory unit 80. The step width determining circuit 9 determines a step width factor, and the step width factor thus determined is applied to the decoding circuit 10. The decoding circuit 10 applies the voice code read out on the basis of the step width factor sent from the step width determining circuit 9. The voice code is decoded into a voice signal corresponding to the original input voice signal by the adder 11 and the prediction circuit 12, so that the voice signal thus decoded is applied to the gain determining circuit 130.

The gain determining circuit 130 reads out the maximum value stored in the storage area B of the memory unit 80. The gain determining circuit 130 determines the gain of the voice signal received from the decoder 100 on the basis of the particular maximum value. In other words, the gain determining circuit 130 determines the gain in such a manner that the maximum value of the amplitude of the voice signal corresponds to an optimum value of the voice volume reproduced. The output signal subjected to gain control is applied to the output side of the speaker or the like.

Figure 5:
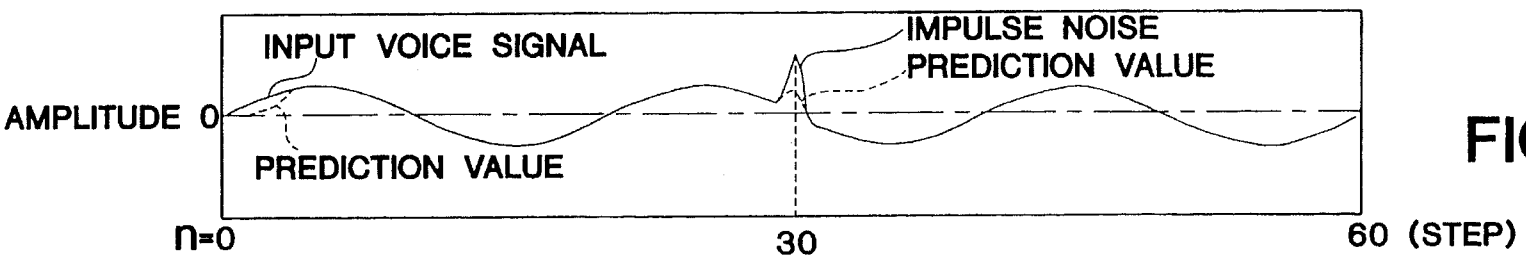
FIG. 5 is a diagram showing an input voice signal with an impulse noise superimposed thereon and an example of prediction value generated by a predictive coding circuit used according to the invention.

Now, an exemplary predictive coding used for the voice codec apparatus according to the present invention will be described below with reference to FIG. 5. FIG. 5 shows an input voice signal (solid line) and a prediction value(broken line) generated by the predictive coding circuit according to the invention. In FIG. 5, the horizontal axis represents steps and the vertical axis represents amplitudes. The input voice signal is assumed to be a sinusoidal wave of a single frequency. An impulse noise having an amplitude twice the maximum amplitude of the input voice signal is superimposed on the input voice signal at step No. 30. A 4-bit ADPCM is used for coding. For example, the coefficients of adaptive quantizing are 0.9 for data of step No. 1 to 3, 1.2 for data of step No. 4, 1.6 for data of step No. 5, 2.0 for data of step No. 6, and 2.4 for data of step No. 7. Table 1 shows step, input voice signal, prediction value, code and quantization width.

TABLE 1

| Step No | Input Voice Signal In | Prediction Value Out | Code | Quantization width Delta |
|---|---|---|---|---|
| 1 | 93 | 15 | 7 | 4.80 |
| 2 | 176 | 51 | 7 | 11.52 |
| 3 | 243 | 137 | 7 | 27.65 |
| 4 | 285 | 289 | 5 | 44.24 |
| 5 | 300 | 312 | 0 | 39.81 |
| 6 | 285 | 292 | 0 | 35.83 |
| 7 | 243 | 238 | 1 | 32.25 |

TABLE 1-continued

| Step No | Input Voice Signal In | Prediction Value Out | Code | Quantization width Delta |
|---|---|---|---|---|
| 8 | 176 | 190 | 1 | 29.02 |
| 9 | 93 | 88 | 3 | 26.12 |
| 10 | 0 | −3 | 3 | 23.51 |
| 11 | −93 | −86 | 3 | 21.16 |
| 12 | −176 | −181 | 4 | 25.39 |
| 13 | −243 | −244 | 2 | 22.85 |
| 14 | −285 | −279 | 1 | 20.57 |
| 15 | −300 | −310 | 1 | 18.51 |
| 16 | −285 | −282 | 1 | 16.66 |
| 17 | −243 | −240 | 2 | 14.99 |
| 18 | −176 | −173 | 4 | 17.99 |
| 19 | −93 | −92 | 4 | 21.59 |
| 20 | −0 | 5 | 4 | 25.91 |
| 21 | 93 | 96 | 3 | 23.32 |
| 22 | 176 | 178 | 3 | 20.98 |
| 23 | 243 | 251 | 3 | 18.89 |
| 24 | 285 | 279 | 1 | 17.00 |
| 25 | 300 | 305 | 1 | 15.30 |
| 26 | 285 | 282 | 1 | 13.77 |
| 27 | 243 | 248 | 2 | 12.39 |
| 28 | 176 | 179 | 5 | 19.83 |
| 29 | 93 | 90 | 4 | 23.79 |
| 30 | 600 | 269 | 7 | 57.10 |
| 31 | −93 | −102 | 6 | 114.20 |
| 32 | −176 | −160 | 0 | 102.78 |
| 33 | −243 | −211 | 0 | 92.50 |
| 34 | −285 | −257 | 0 | 83.25 |
| 35 | −300 | −299 | 0 | 74.93 |
| 36 | −285 | −261 | 0 | 67.43 |
| 37 | −243 | −228 | 0 | 60.69 |
| 38 | −176 | −197 | 0 | 54.62 |
| 39 | −93 | −115 | 1 | 49.16 |
| 40 | −0 | 8 | 2 | 44.24 |
| 41 | 93 | 74 | 1 | 39.82 |
| 42 | 176 | 173 | 2 | 35.84 |
| 43 | 243 | 227 | 1 | 32.25 |
| 44 | 285 | 276 | 1 | 29.03 |
| 45 | 300 | 290 | 0 | 26.12 |
| 46 | 285 | 277 | 0 | 23.51 |
| 47 | 243 | 242 | 1 | 21.16 |
| 48 | 176 | 168 | 3 | 19.05 |
| 49 | 93 | 101 | 3 | 17.14 |
| 50 | 0 | 7 | 5 | 27.42 |
| 51 | −93 | −89 | 3 | 24.68 |
| 52 | −176 | −176 | 3 | 22.21 |
| 53 | −243 | −253 | 3 | 19.99 |
| 54 | −285 | −283 | 1 | 17.99 |
| 55 | −300 | −292 | 0 | 16.19 |
| 56 | −285 | −284 | 0 | 14.57 |
| 57 | −243 | −248 | 2 | 13.12 |
| 58 | −176 | −176 | 5 | 20.99 |
| 59 | −93 | −102 | 3 | 18.89 |
| 60 | −0 | 2 | 5 | 30.22 |

At step No. 30, the amplitude of the input voice signal is sharply increased to 600, or twice the maximum value 300 for the input voice signal, due to the impulse noise. In contrast, the amplitude of the prediction value changes only to 269. In other words, the predictive coding reduces the impulse noise. In the case under consideration, the maximum prediction value coincides with the maximum value of the input voice signal and is not affected by the impulse noise. In this way, a voice signal of appropriate amplitude can be reproduced by determining the gain on the basis of the maximum prediction value in accordance to predictive coding.

The coincidence failure between the amplitude of the prediction value and the input voice signal in initial period of input is by the reason of the fact that the initial value of the quantization width is set to minimum. With subsequent adaptation of the quantization width to the voice signal, however, the prediction value and the amplitude of the input voice signal come to coincide in satisfactory manner.

Also, the coding and decoding of the input voice signal can be performed by software. As a result, instead of adding the maximum value detection circuit 70 and the gain determining circuit 130 as according to the invention to the hardware, a ROM, an MPU or a RAM carrying the software corresponding to the circuit operations involved may be added to realize a voice codec apparatus according to the invention.

Further, the predictive coding system used for the voice codec apparatus according to the invention is not limited to the use of differential quantization as described above, but also a wide variety of well-known predictive coding methods are applicable, too.

It will thus be understood from the foregoing description that, according to the voice codec apparatus of the invention, the gain of the output signal can be accurately controlled even when an impulse noise having an amplitude larger than the maximum amplitude of an input voice signal is superimposed on the input voice signal. As a result, in the telephone or acoustic devices having a voice codec apparatus according to the invention, an input signal can be reproduced with high accuracy even when an impulse noise is superimposed on the input voice signal. Also, the predictive coding by differential quantization permits high compression of data thus opening the way for use of a small-capacity solid-state storage device typically including a RAM as a storage device.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A voice codec apparatus comprising:

predictive coding means for generating a voice code and a prediction value from an input voice signal containing noise;

maximum detecting means for detecting a maximum value of said prediction value;

decoding means for decoding said voice code to generate a decoded voice signal; and gain control means for controlling gain of the decoded voice signal at the end of decoding to produce an output voice signal limited by the detected maximum value of said prediction value to thereby eliminate at least a portion of the noise from the input voice signal.

2. A voice codec apparatus comprising:

predictive coding means for generating a voice code and a prediction value from an input voice signal containing noise;

maximum detecting means for detecting a maximum value of said prediction value at the end of coding;

memory means for storing said maximum value and said voice code;

decoding means for decoding said voice code to generate a decoded voice signal; and gain determining means for reading said maximum value stored in said memory means and for determining a gain of said decoded voice signal of said decoding means to produce an output voice signal limited by said maximum value to thereby eliminate at least a portion of the noise from the input voice signal.

3. A voice codec apparatus according to claim 2, wherein said predictive coding means makes predictive coding by a differential quantization.

4. A voice codec apparatus according to claim 2, wherein said memory means is a solid-state memory device for storing said voice code and said maximum value.

5. A method of coding a voice signal and decoding a coded voice signal comprising the steps of:

(a) generating a voice code and a prediction value from an input voice signal containing noise;

(b) detecting, after step (a), a maximum value of said prediction value;

(c) storing said maximum value and said voice code;

(d) decoding said voice code and outputting a decoded voice signal; and (e) reading said maximum value stored at said storing step (c) and determining a gain of said decoded voice signal to produce an output voice signal limited by said maximum value to thereby eliminate at least a portion of the noise from the input voice signal.

* * * * *